US009822647B2

(12) United States Patent
Subbareddyar et al.

(10) Patent No.: US 9,822,647 B2
(45) Date of Patent: Nov. 21, 2017

(54) HIGH CHORD BUCKET WITH DUAL PART SPAN SHROUDS AND CURVED DOVETAIL

(71) Applicant: General Electric Company, Schenectady, NY (US)

(72) Inventors: Thangaraj Subbareddyar, Bangalore (IN); Moorthi Subramaniyan, Bangalore (IN); Srikeerthi Annaluri, Bangalore (IN)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 14/167,788

(22) Filed: Jan. 29, 2014

(65) Prior Publication Data

US 2015/0211373 A1 Jul. 30, 2015

(51) Int. Cl.
*F01D 5/22* (2006.01)

(52) U.S. Cl.
CPC ..... *F01D 5/225* (2013.01)

(58) Field of Classification Search
CPC ..... F01D 5/225
See application file for complete search history.

(56) References Cited

U.S. PATENT DOCUMENTS

| | | | |
|---|---|---|---|
| 299,631 | A | 6/1884 | Eichling |
| 2,772,854 | A | 12/1956 | Anxionnaz |
| 3,795,462 | A | 3/1974 | Trumpler |
| 4,326,836 | A | 4/1982 | Fitton |
| 4,919,593 | A | 4/1990 | Brown |
| RE33,954 | E | 6/1992 | Honda et al. |
| 5,257,908 | A | 11/1993 | Ortolano |
| 5,393,200 | A | 2/1995 | Dinh et al. |
| 5,540,551 | A | 7/1996 | Heinig |
| 5,599,165 | A | 2/1997 | Elaini et al. |
| 5,660,523 | A | 8/1997 | Lee |
| 8,105,038 | B2 | 1/2012 | Ootomo et al. |
| 8,118,557 | B2 | 2/2012 | DeMania et al. |
| 8,182,228 | B2 | 5/2012 | Riley et al. |
| 2010/0158696 | A1 | 6/2010 | Pandey et al. |
| 2010/0247315 | A1 | 9/2010 | DeMania et al. |
| 2012/0093654 | A1 | 4/2012 | Ahmed et al. |
| 2015/0377036 | A1* | 12/2015 | Schwarz ..... F01D 5/225 415/211.2 |

FOREIGN PATENT DOCUMENTS

| | | |
|---|---|---|
| EP | 1 914 384 | 4/2008 |
| EP | 2 236 755 | 10/2010 |
| WO | 2014143292 A1 | 9/2014 |

OTHER PUBLICATIONS

GB Combined Search and Examination Report issued in connection with corresponding GB Application No. 1501291.7 dated Jul. 13, 2015.

* cited by examiner

*Primary Examiner* — Moshe Wilensky
(74) *Attorney, Agent, or Firm* — Nixon & Vanderhye P.C.

(57) ABSTRACT

A turbine bucket includes an entry dovetail; an airfoil portion extending from the entry dovetail, the airfoil portion having a leading edge, a trailing edge, a pressure side and a suction side. Radially inner- and outer-span shrouds are provided on each of the pressure side and the suction side, the part-span shrouds each having hard faces adapted to engage and slide relative to corresponding part-span shrouds on adjacent buckets.

6 Claims, 4 Drawing Sheets

HIGH CHORD BUCKET WITH DUAL PART SPAN SHROUDS AND CURVED DOVETAIL

BACKGROUND OF THE INVENTION

The invention relates generally to rotor wheels supporting rows of blades or buckets for use in turbomachines. More particularly, the invention relates to rotating blades or buckets provided with part-span shrouds between airfoil portions of adjacent blades.

The fluid flow path of a turbomachine such as a steam or gas turbine is generally formed by a stationary casing and a rotor. In this configuration, a number of stationary vanes are attached to the casing in a circumferential array, extending radially inward into the flow path. Similarly, a number of rotating blades or buckets are attached to the rotor in a circumferential array extending radially outward into the flow path. The stationary vanes and rotating blades or buckets are arranged in alternating rows so that a row of vanes and the immediate downstream row of blades or buckets form a "stage". The vanes serve to direct the flow path working fluid so that it enters the downstream row of blades or buckets at the correct angle. The airfoil portions (or, simply, airfoils) of the blades or buckets extract energy from the working fluid, thereby developing the power necessary to drive the rotor and an attached load, e.g., a generator.

The blades or buckets of the turbomachine may be subject to vibration and axial torsion as they rotate at high speeds. To address these issues, the blades or buckets in some stages may include part-span shrouds disposed on the airfoil at an intermediate radial distance between the tip and the root sections of the airfoil. The part-span shrouds are typically affixed to each of the pressure (concave) and suction (convex) sides of each airfoil, such that the part-span shrouds on adjacent blades matingly engage and frictionally slide along mated "hard faces" during rotation of the rotor.

In addition to part-span shrouds, it is often the practice to utilize tip shrouds attached to (or formed on) the radially outermost ends of the blade airfoils. Tip shrouds are also used to dampen vibrations and to control the amount of flexure at the outer tips of the blades or buckets.

There remains a need, however for bucket shroud designs that enhance bucket performance and/or that provide the opportunity to permit airfoil designs that also enhance performance by, for example, improving mechanical damping and creep life.

BRIEF DESCRIPTION OF THE INVENTION

In a first exemplary but nonlimiting embodiment, the invention provides a turbine bucket comprising an entry dovetail; an airfoil portion extending from the entry dovetail, the airfoil portion having a leading edge, a trailing edge, a pressure side and a suction side; and radially inner- and outer-part-span shrouds on each of the pressure side and the suction side of the airfoil portion, radially between the entry dovetail and an outer tip of the airfoil portion, the radially-inner and radially-outer part-span shrouds having hard faces adapted to engage and slide relative to hard faces of corresponding radially-inner and radially-outer part-span shrouds on adjacent buckets.

In another exemplary but nonlimiting embodiment, the invention provides a rotor wheel for a turbine comprising a row of buckets mounted about an outer periphery of the rotor wheel, each bucket comprising an entry dovetail; an airfoil portion extending radially outwardly from the entry dovetail; and radially inner and outer part-span shrouds on each of the pressure side and the suction side of the airfoil portion, radially between the entry dovetail and a radially-outer tip of the airfoil portion, the part-span shrouds each having hard faces adapted to engage and slide relative to corresponding part-span shrouds on adjacent buckets at turbine operating temperature.

In still another exemplary but nonlimiting embodiment, the invention provides a turbine rotor provided with at least one wheel supporting a row of buckets on a periphery of said at least one wheel, each bucket comprising a turbine bucket comprising an entry dovetail; an airfoil portion extending from the entry dovetail; radially inner- and outer-span shrouds on each of the pressure side and the suction side of the airfoil portion, radially between the entry dovetail and an outer tip, the part-span shrouds each having hard faces adapted to engage and slide relative to corresponding part-span shrouds on adjacent buckets at turbine operating temperature; wherein the radially inner part-span shroud lies in a range of from 20-60% of a radial length of the airfoil portion, as measured from a radially innermost end of the airfoil portion, and the radially outer part-span shroud lies in a range of from 60-90% of the radial length dimension; and wherein each of the radially inner and outer part-span shrouds extend 20-75% of a width dimension of the airfoil portion as measured between leading and trailing edges of the airfoil portion; and further wherein a radial distance between the radially-inner and radially-outer part-span shrouds is at least 10% of the radial length.

The invention will now be described in detail in connection with the drawings identified below.

DETAILED DESCRIPTION OF THE INVENTION

At least one embodiment of the present invention is described below in reference to its application in connection with the operation of an otherwise conventional gas turbine engine. Although embodiments of the invention are illustrated relative to gas turbine engines employed in the production of electricity, it is understood that the teachings may be applicable to other electric turbomachines including, but not limited to, steam turbine engines compressors, fans, etc.

Figure 1:
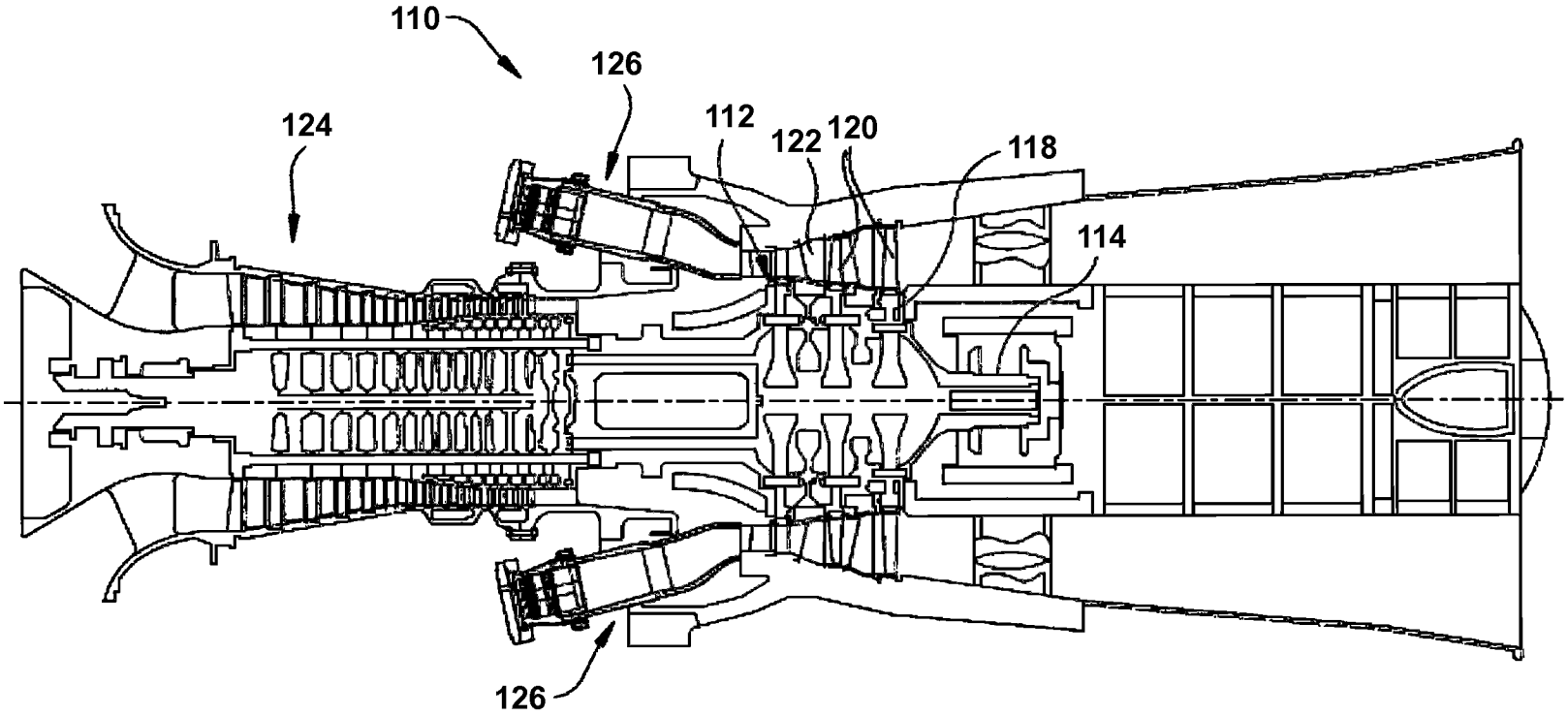
FIG. 1 is a simplified side elevation of a conventional gas turbine engine.

With reference to FIG. 1, a cross-sectional illustration of a conventional gas turbine 110 is shown. The gas turbine 110 includes a rotor 112 that includes a shaft 114 and a plurality of axially spaced rotor wheels 118. A plurality of rotating buckets or blades 120 are mechanically coupled to each rotor wheel 118. More specifically, blades 120 are arranged in rows that extend circumferentially around each rotor wheel 118. A plurality of stationary vanes 122 extend circumferentially around shaft 114 and are axially positioned between adjacent rows of blades 120.

During operation, air at atmospheric pressure is compressed by a compressor 124 and delivered to a plurality of combustors 126 arranged in an annular array about the turbine rotor 112. In the combustion stage, the air leaving the compressor is heated by adding fuel to the air and burning the resulting air/fuel mixture. The gas flow resulting from combustion of fuel in the combustion stage then expands through the turbine 110, delivering some of its energy to drive the turbine 110 and, e.g., a generator (not shown) to produce electrical power. To produce the required driving torque, turbine 110 consists of one or more stages. Each stage includes a row of the stationary vanes 122 and a row of the rotating blades 120 mounted on the rotor wheel 118. The stationary vanes 122 direct the incoming gas from the combustion stage onto the rotating blades 120 to thereby drive the rotor wheel(s) 118, and rotor shaft 114.

Figure 2:
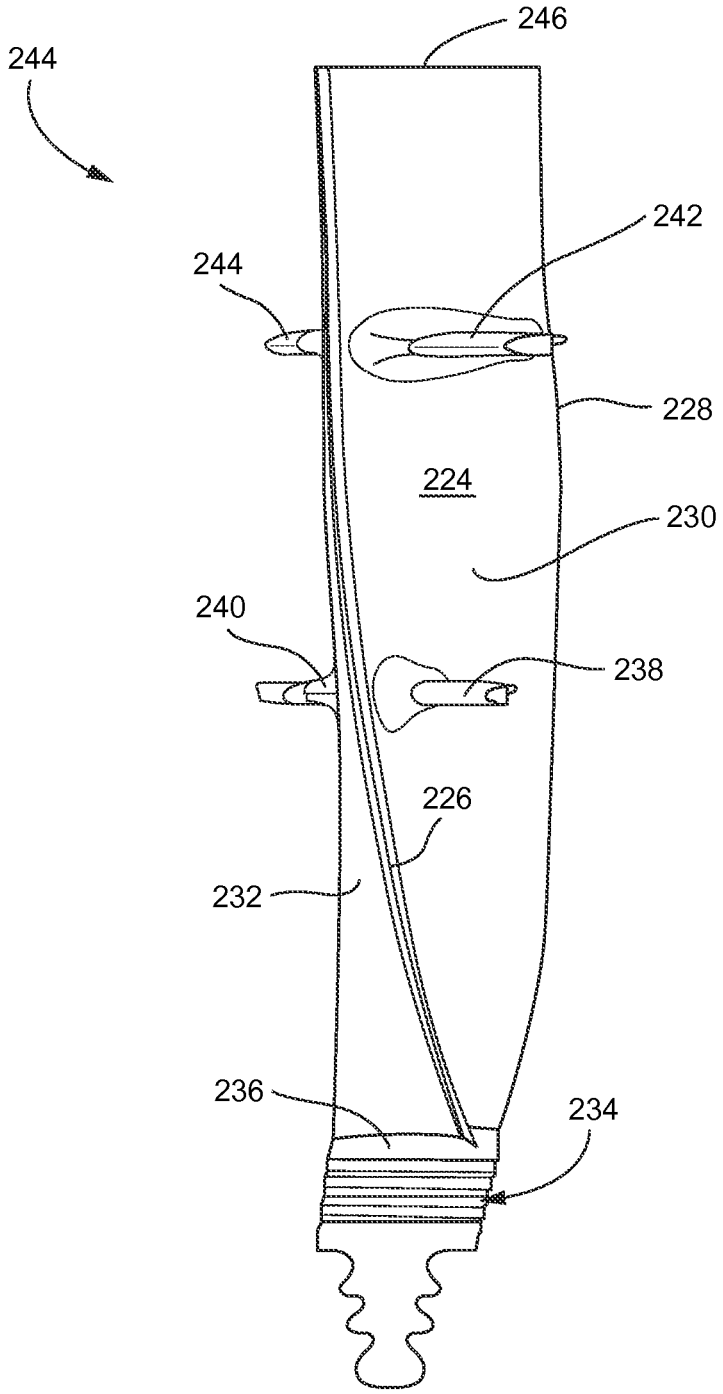
FIG. 2 is a perspective view of a bucket in accordance with a first exemplary but nonlimiting embodiment of the invention.

With reference to FIG. 2, a turbine blade or bucket 220 in accordance with a first exemplary but nonlimiting embodiment of the invention includes an airfoil portion or airfoil 224 which is formed with a leading edge 226, a trailing edge 228, a pressure side 230 and a suction side 232. The bucket is also provided with an entry dovetail 234 by which the bucket is mounted on a wheel (e.g., wheel 118) secured to the turbine rotor. The entry dovetail 234 and airfoil 224 are separated by a platform 236 which may be provided with so-called "angel-wing" seals (not shown) of conventional construction.

The airfoil 224 is provided with a pair of radially inner part-span shrouds 238, 240 extending circumferentially away from opposite sides of the airfoil, i.e, with part-span shroud 238 extending from the pressure side 230 and part-span shroud 240 extending from the suction side 232. Except for the positional relationships described below, such part-span shrouds are of known construction, and are typically combined with tip shrouds provided at the radially outermost tips of the blade airfoils.

In accordance with this exemplary disclosure, the airfoil 224 is also provided with a pair of radially outer part-span shrouds 242, 244, also extending circumferentially away from opposite sides of the airfoil, i.e, with outer part-span shroud 242 extending from the suction side 232 and outer part-span shroud 244 extending from the pressure side 230. Note that the radially-outer part span shrouds are located radially inward of the blade or bucket tip 246.

By employing a second set of part-span shrouds, i.e., the radially outer part-span shrouds 242, 244, it is possible to eliminate the conventional airfoil tip shroud(s), and thereby reduce pull loads while achieving the desired mechanical damping. It will be understood, however, that an airfoil tip shroud may be used in combination with the outer part-span shrouds if desired. It is also contemplated that the airfoil be provided with a so-called "squealer tip". Squealer tips are well known for their ability to improve sealing between a rotating blade tip and an associated stationary stator shroud. A typical squealer includes a continuous peripheral end wall of relatively small height surrounding and projecting outwardly from an airfoil end cap. Examples may be found in commonly-owned U.S. Pat. No. 5,660,523.

In some exemplary but nonlimiting configurations, the radially inner part-span shrouds 238, 240 are located within a range of from about 20% to about 60& of the radial span of the airfoil, as measured from the platform 236 (or the radially innermost end of the airfoil portion), and the radially outer part-span shrouds 242, 244 are located about 60% to 90& of the radial length of the airfoil, as also measured from the platform 236. At the same time, the minimal radial distance between the inner part-span shrouds 238, 240 and the outer part-span shrouds 242-244 is about 10% of the radial length of the airfoil 224.

The part-span shrouds (both inner and outer) may have airfoil cross-sectional shapes, with a chord aspect ratio in an exemplary embodiment of this disclosure, in a range of between 1.05 and 1.2. It will be appreciated that other aerodynamic cross-sectional shapes are within the scope of the invention. The trailing edge of each part-span shroud may be spaced from the trailing edge 228 of the blade 220 by about 10% to about 90% of the chord length of the part-span shroud, and the part-span shrouds may have a length of about 20-75% of the blade width (i.e., the distance between the leading edge 226 and the trailing edge 228).

The radially-outer tips 246 of the buckets or blades 220 within a row of similar blades may, collectively, form a cylinder, (i.e., the tips 246 are parallel to, or lie in planes parallel to the rotor axis), or the individual tips may be angled relative to each other and to the rotor axis.

Figure 4:
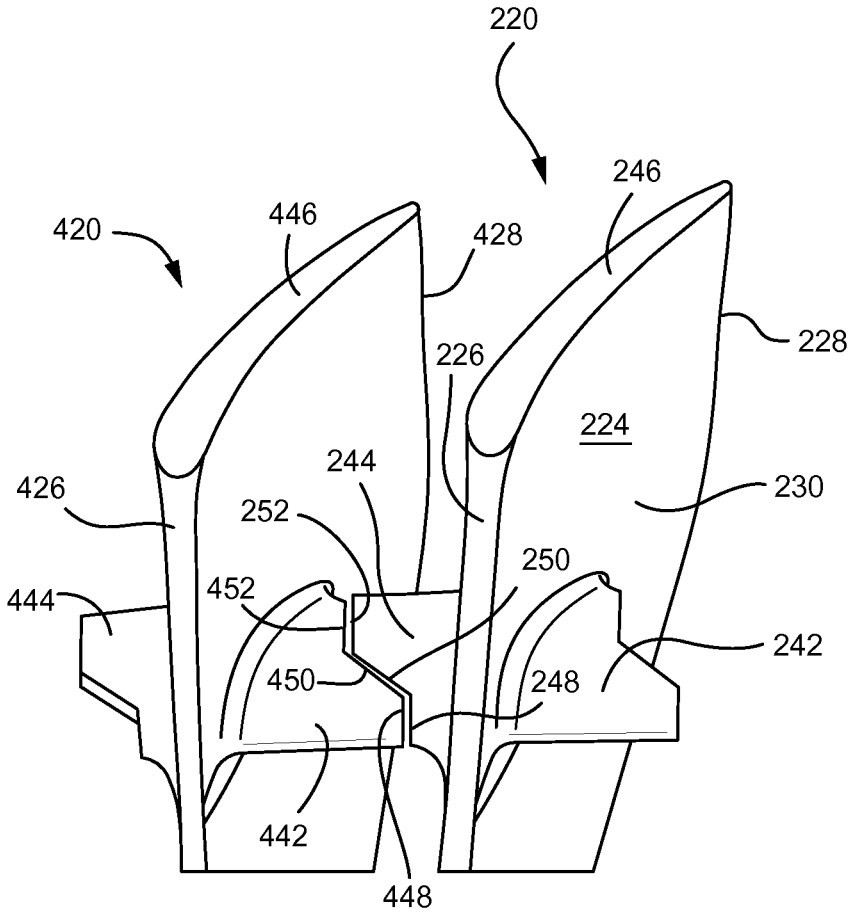
FIG. 4 is a partial perspective view illustrating an exemplary mated engagement between radially-outer part-span shrouds on adjacent buckets.

It will also be appreciated that the outer edges or hard faces 248, 250 of the part-span shrouds 242, 244 may be straight or may have other configurations, such as V-shaped or Z-shaped, to engage complimentary, mating edge surfaces or adjacent part-span shrouds of adjacent buckets when the turbine has reached its normal operating temperature. A Z-shaped engagement configuration is shown in FIG. 4. For the part-span shroud 244, the hard face comprises parallel surfaces 248 and 252, connected by angled surface 250. These surface interact with corresponding hard face surfaces 448, 452 and 450 on the adjacent bucket, where the angled surfaces 250 and 450 define an angle of between about 20 and 80 degrees relative to the axis of the turbine rotor shaft. It will also be appreciated that the blades or buckets may be hollow and may be provided with internal cooling circuits (not shown) which extend into one or both of the radially-inner and radially-outer part-span shrouds, and which may or may not include cooling exit openings or apertures along the part-span shrouds.

Figure 3:
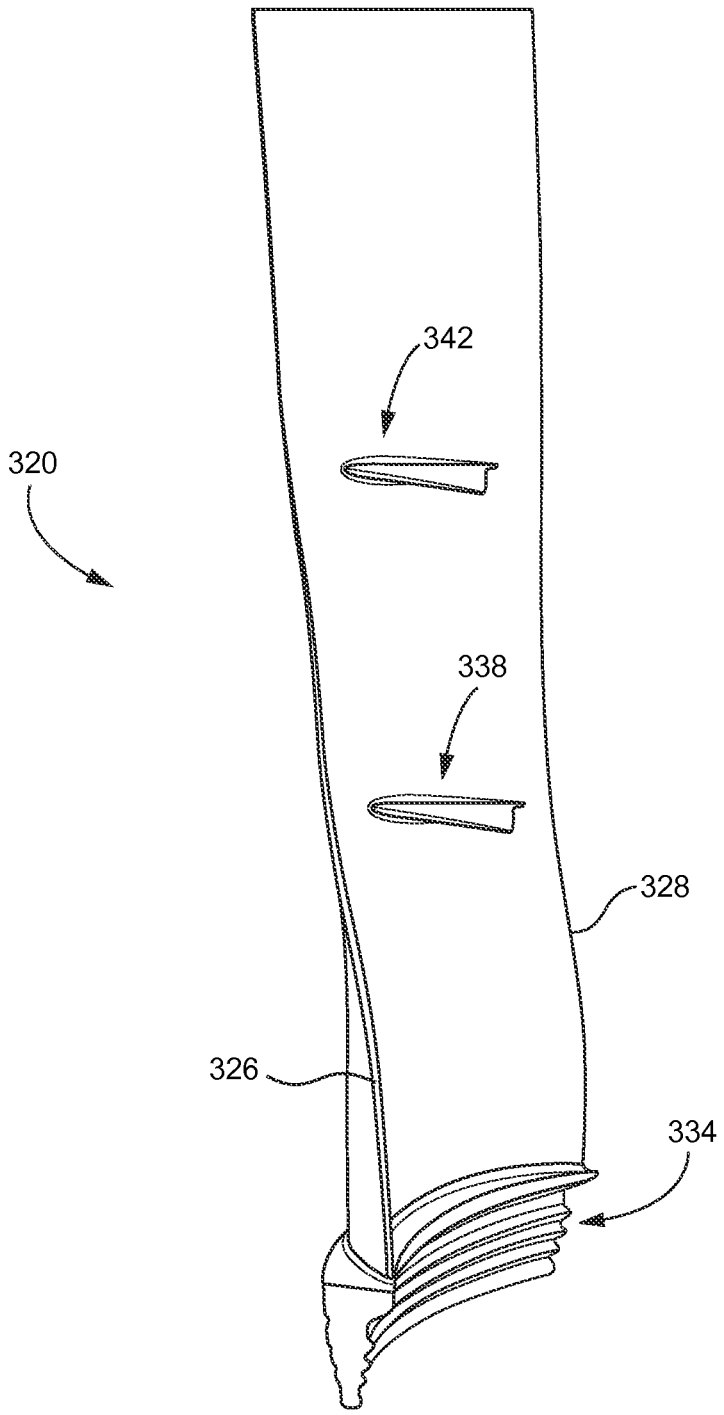
FIG. 3 is a perspective view of a bucket in accordance with a second exemplary but nonlimiting embodiment of the invention.

In a second exemplary but nonlimiting embodiment illustrated in FIG. 3. The blade or bucket 320 has a part-span shroud arrangement similar to that described above, but the entry dovetail 332 is curved, continuously from end-to-end as best seen in FIG. 4. The curved-entry dovetail facilitates high-chord bucket designs with less axial length. The part-span shroud arrangement may be otherwise similar to that shown in FIGS. 2 and 4.

By providing dual part-span shroud arrangements as described herein, aeromechanical benefits may be achieved, including increased frequencies and vibratory capability, high-chord buckets, short-shank buckets which do not require damping pins, reduced potential for flutter issues and improved creep life through the elimination of blade tip shrouds.

What is claimed is:

1. A turbine bucket comprising:

an entry dovetail;

an airfoil portion extending from the entry dovetail, the airfoil portion having a leading edge, a trailing edge, a pressure side and a suction side; and radially-inner and radially-outer part-span shrouds on each of the pressure side and the suction side of the airfoil portion, radially between the entry dovetail and an outer tip of the airfoil portion, the radially-inner and radially-outer part-span shrouds on both the pressure side and the suction side of the airfoil portion having faces adapted to engage and slide relative to faces of corresponding radially-inner and radially-outer part-span shrouds on adjacent buckets, wherein at least the radially-inner part-span shrouds have airfoil-shaped cross sections, the airfoil-shaped cross-sections being formed with a chord aspect ratio in the range of 1.05 to 1.2, each of the radially-inner part-span shroud on the pressure side and the radially-inner part-span shroud on the suction side having a leading edge and a trailing edge, a span of the radially-inner part-span shrouds being measured as a sum of 1) a distance from the pressure side of the airfoil portion along the leading edge of the radially-inner part-span shroud on the pressure side to the face of the radially-inner part-span shroud on the pressure side and 2) a distance from the suction side of the airfoil portion along the leading edge of the radially-inner part-span shroud on the suction side to the face of the radially-inner part-span shroud on the suction side, wherein the radially inner part-span shroud lies in a range of from 20-60% of a radial length of the airfoil portion, as measured from a radially innermost end of the airfoil portion, wherein the radially outer part-span shroud lies in a range of from 60-90% of a radial length dimension of the airfoil portion as measured from a radially innermost location on the airfoil portion, wherein the entry dovetail is curved from a leading edge of the airfoil portion to a trailing edge of the airfoil portion, wherein an outermost end of the bucket is provided with a squealer tip, and wherein said faces of at least said radially outer part-span shrouds are substantially Z-shaped and include a pair of parallel surfaces connected by an angled surface, the angled surface defining an angle of between 20 and 80 degrees relative to an axis of a turbine rotor shaft.

2. The turbine bucket of claim 1 wherein at least the outer part-span shrouds extend 20-75% of a width dimension of the airfoil portion as measured between the leading and trailing edges of the airfoil portion.

3. The turbine bucket of claim 1 wherein a radial distance between the radially-inner and radially-outer part-span shrouds is at least 10% of a radial length of the airfoil portion as measured from a radially-innermost end of the airfoil portion.

4. A rotor wheel for a turbine comprising a row of buckets mounted about an outer periphery of the rotor wheel, each bucket comprising:

an entry dovetail;

an airfoil portion extending radially outwardly from the entry dovetail; and radially-inner and radially-outer part-span shrouds on each of the pressure side and the suction side of the airfoil portion, radially between the entry dovetail and a radially-outer tip of the airfoil portion, the radially-inner and radially-outer part-span shrouds on both the pressure side and the suction side of the airfoil having faces adapted to engage and slide relative to faces of corresponding part-span shrouds on adjacent buckets at turbine operating temperature, wherein the radially-inner part-span shrouds and the radially-outer part-span shrouds have airfoil-shaped cross sections, the airfoil-shaped cross-sections being formed with a chord aspect ratio in the range of 1.05 to 1.2, a span of the radially-inner part-span shrouds and the radially-outer part-span shrouds being measured as a distance between the airfoil portion and a respective adjacent bucket, wherein the radially inner part-span shroud lies in a range of from 20-60% of a radial length of the airfoil portion, as measured from a radially innermost end of the airfoil portion, wherein the radially outer part-span shroud lies in a range of from 60-90% of a radial length dimension of the airfoil portion as measured from a radially innermost location on the airfoil portion, wherein the entry dovetail is curved from a leading edge of the airfoil portion to a trailing edge of the airfoil portion, wherein an outermost end of the bucket is provided with a squealer tip, and wherein said faces of at least said radially outer part-span shrouds are substantially Z-shaped and include a pair of parallel surfaces connected by an angled surface, the angled surface defining an angle of between 20 and 80 degrees relative to an axis of a turbine rotor shaft.

5. The rotor wheel of claim 4 wherein a radial distance between the radially-inner and outer part-span shrouds is at least 10% of a radial length of the airfoil portion as measured from a radially-innermost end of the airfoil portion.

6. A turbine rotor provided with at least one wheel supporting a row of buckets on a periphery of said at least one wheel, each rotor comprising:

a turbine bucket comprising an entry dovetail;

an airfoil portion extending from the entry dovetail; and radially-inner and radially-outer part-span shrouds on each of the pressure side and the suction side of the airfoil portion, radially between the entry dovetail and an outer tip, the radially-inner and radially-outer part-span shrouds on both the pressure side and the suction side of the airfoil portion having faces adapted to engage and slide relative to corresponding part-span shrouds on adjacent buckets at turbine operating temperature, wherein the radially-inner part-span shrouds and the radially-outer part-span shrouds have airfoil-shaped cross sections, the airfoil-shaped cross-sections being formed with a chord aspect ratio in the range of 1.05 to 1.2, a span of the radially-inner part-span shrouds and the radially-outer part-span shrouds being measured as a distance between the airfoil portion and a respective adjacent bucket, wherein the entry dovetail is curved from a leading edge of the airfoil portion to a trailing edge of the airfoil portion, wherein an outermost end of the bucket is provided with a squealer tip, and wherein said faces of at least said radially outer part-span shrouds are substantially Z-shaped and include a pair of parallel surfaces connected by an angled surface, the angled surface defining an angle of between 20 and 80 degrees relative to an axis of a turbine rotor shaft, wherein the radially inner part-span shroud lies in a range of from 20-60% of a radial length of the airfoil portion, as measured from a radially innermost end of the airfoil portion, and the radially outer part-span shroud lies in a range of from 60-90% of the radial length dimension; and wherein each of the radially inner and radially-outer part-span shrouds extend 20-75% of a width dimension of the airfoil portion as measured between leading and trailing edges of the airfoil portion; and further wherein a radial distance between the radially-inner and radially-outer part-span shrouds is at least 10% of the radial length.

* * * * *